US010475605B2

(12) United States Patent
Jansen et al.

(10) Patent No.: US 10,475,605 B2
(45) Date of Patent: Nov. 12, 2019

(54) ACTUATOR ALTERNATING INDICATOR LIGHT

(71) Applicant: Leviton Manufacturing Co., Inc., Melville, NY (US)

(72) Inventors: Ronald Jansen, Ridgewood, NY (US); Alfred Lombardi, Syosset, NY (US); Adam Kevelos, Plainview, NY (US)

(73) Assignee: LEVITON MANUFACTURING CO., INC., Melville, NY (US)

( * ) Notice: Subject to any disclaimer, the term of this patent is extended or adjusted under 35 U.S.C. 154(b) by 0 days.

(21) Appl. No.: 16/365,199

(22) Filed: Mar. 26, 2019

(65) Prior Publication Data

US 2019/0221386 A1 Jul. 18, 2019

Related U.S. Application Data

(63) Continuation of application No. 15/790,745, filed on Oct. 23, 2017, now Pat. No. 10,276,332.
(Continued)

(51) Int. Cl.
*H01H 23/02* (2006.01)
*H05B 37/02* (2006.01)
(Continued)

(52) U.S. Cl.
CPC ..... *H01H 23/025* (2013.01); *H01H 23/003* (2013.01); *H01H 23/145* (2013.01);
(Continued)

(58) Field of Classification Search
CPC .. H01H 23/025; H01H 23/145; H01H 23/003; H01H 23/162; H01H 9/161;
(Continued)

(56) References Cited

U.S. PATENT DOCUMENTS 3,986,022 A 10/1976 Hyatt
4,654,626 A 3/1987 Carsello
(Continued)

OTHER PUBLICATIONS

Adam Kevelos, pending U.S. Appl. No. 14/455,616, filed Aug. 8, 2014, "Dimmer Switch Having Dimmer Actuator Operable for Actuating an Air-Gap Switch".
(Continued)

*Primary Examiner* — Ahmed M Saeed
*Assistant Examiner* — Lheiren Mae A Caroc
(74) *Attorney, Agent, or Firm* — Heslin Rothenberg Farley & Mesiti P.C.

(57) ABSTRACT

An exemplary embodiment of a load control device with a light indicator is disclosed. The load control device may include an actuator assembly and a light source. The actuator assembly may include a frame, a light pipe, and an actuator having two surfaces. The light pipe may be arranged within the actuator and include first and second legs. The first leg may extend towards the first surface, and the second leg may extend towards the second surface. When the actuator is in a first position, the light source may be optically aligned with one of the first and second legs; and, when the actuator is in a second position, the light source may be optically aligned with the other of the first and second legs. When the light source is illuminated, the light pipe may direct the light towards the respective surface of the actuator.

20 Claims, 9 Drawing Sheets

Related U.S. Application Data

(60) Provisional application No. 62/416,597, filed on Nov. 2, 2016.

(51) Int. Cl.

| | |
|---|---|
| ***H01H 23/16*** | (2006.01) |
| ***H01H 23/00*** | (2006.01) |
| ***H01H 23/14*** | (2006.01) |
| *H01H 71/04* | (2006.01) |
| *H01H 9/18* | (2006.01) |
| *H01H 9/16* | (2006.01) |

(52) U.S. Cl.
CPC ..... *H01H 23/162* (2013.01); *H05B 37/02* (2013.01); *H01H 9/161* (2013.01); *H01H 9/182* (2013.01); *H01H 2071/042* (2013.01); *H01H 2219/062* (2013.01)

(58) Field of Classification Search
CPC ..... H01H 2219/062; H01H 9/182; H01H 2071/042; H05B 37/02
USPC ..... 200/310–313, 315
See application file for complete search history.

(56) References Cited

U.S. PATENT DOCUMENTS

| | | | |
|---|---|---|---|
| 5,012,495 | A | 4/1991 | Munroe et al. |
| 5,262,678 | A | 11/1993 | Flowers et al. |
| 5,359,231 | A | 10/1994 | Flowers et al. |
| 5,637,930 | A | 6/1997 | Rowen et al. |
| 5,945,647 | A | 8/1999 | Hoskins |
| 6,005,308 | A | 12/1999 | Bryde et al. |
| 6,259,351 | B1 | 7/2001 | Radosavljevic et al. |
| 6,734,381 | B2 | 5/2004 | Mayo et al. |
| 7,170,018 | B2 | 1/2007 | Ilkhanov |
| 7,345,998 | B2 | 3/2008 | Cregg et al. |
| 7,400,239 | B2 | 7/2008 | Kiko et al. |
| D603,809 | S | 11/2009 | Mathew et al. |
| 7,663,325 | B2 | 2/2010 | McDonough et al. |
| 7,670,039 | B2 | 3/2010 | Altonen et al. |
| 7,777,145 | B2 | 8/2010 | Burrell et al. |
| 7,837,344 | B2 | 11/2010 | Altonen et al. |
| 7,985,937 | B2 | 7/2011 | Wu et al. |
| 8,003,904 | B2 | 8/2011 | Wu |
| 8,124,898 | B2 | 2/2012 | Mathew et al. |
| 8,138,435 | B2 | 3/2012 | Patel et al. |
| 8,173,920 | B2 | 5/2012 | Altonen et al. |
| 8,367,955 | B2 | 2/2013 | Strothmann |
| 8,459,812 | B2 | 6/2013 | Wu et al. |
| 8,536,473 | B2 | 9/2013 | Goyal et al. |
| 8,558,470 | B2 | 10/2013 | Shteynberg et al. |
| 8,624,142 | B2 | 1/2014 | Mathew et al. |
| 8,669,720 | B2 | 3/2014 | Goyal et al. |
| 8,717,718 | B2 | 5/2014 | Kamor et al. |
| 9,029,720 | B2 | 5/2015 | Strothmann |
| 9,329,607 | B2 | 5/2016 | Kevelos et al. |
| 9,389,769 | B1 | 7/2016 | OKeeffe |
| 9,398,667 | B2 * | 7/2016 | Kevelos ..... H05B 37/02 |
| 9,681,526 | B2 | 6/2017 | Ostrovsky et al. |
| 9,767,973 | B2 | 9/2017 | Kevelos et al. |
| 9,916,946 | B1 | 3/2018 | Mathew et al. |
| 10,062,528 | B2 | 8/2018 | Kevelos et al. |
| 10,276,332 | B2 | 4/2019 | Jansen et al. |
| 2005/0099824 | A1 | 5/2005 | Dowling et al. |
| 2007/0193863 | A1 | 8/2007 | Wu |
| 2008/0151458 | A1 | 6/2008 | Beland et al. |
| 2009/0256483 | A1 | 10/2009 | Gehman et al. |
| 2010/0101924 | A1 | 4/2010 | Wu et al. |
| 2012/0257316 | A1 | 10/2012 | Kamor et al. |
| 2013/0026947 | A1 | 1/2013 | Economy et al. |
| 2013/0162167 | A1 | 6/2013 | Gallo |
| 2013/0162168 | A1 | 6/2013 | Ostrovsky |
| 2014/0253483 | A1 | 9/2014 | Kupersztoch et al. |
| 2015/0144470 | A1 | 5/2015 | Chang |
| 2015/0203056 | A1 * | 7/2015 | Adkins ..... H03K 17/962 307/10.1 |
| 2016/0041569 | A1 | 2/2016 | Kevelos et al. |
| 2016/0268074 | A1 | 9/2016 | Kevelos et al. |
| 2017/0194118 | A1 | 7/2017 | Brudzynsky et al. |

OTHER PUBLICATIONS

Product Brochure for the Mural Collection, Leviton Manufacturing Co., Inc., Mellville, New York, 12 pages. 2000.
Product Brochure for the Mural Collection II, Leviton Manufacturing Co., Inc., Melville, New York, 7 pages. 2002.
Product Specifications, Inf. Cat. No. 664-I, Leviton. 2007.
Matthew et al., pending U.S. Appl. No. 15/341,937, filed Nov. 2, 2016, entitled "Dimmer Switches and Assemblies for Dimmer Switches".
Kevelos et al., pending U.S. Appl. No. 15/706,045, filed Sep. 15, 2017, entitled "Electrical Load Controller Having a Frame With an Integrally Formed Backlightable Indicator Region" and Preliminary Amendment of Sep. 15, 2017.

* cited by examiner

ACTUATOR ALTERNATING INDICATOR LIGHT

CLAIM TO PRIORITY

This application is a continuation of U.S. patent application Ser. No. 15/790,745, filed Oct. 23, 2017, and entitled "Actuator Alternating Indicator Light," which application claims the benefit of U.S. Provisional Application No. 62/416,597, filed Nov. 2, 2016, entitled "Actuator Alternating Indicator Light", by Ronald Jansen, Alfred Lombardi, and Adam Kevelos. The entire subject matter of these applications being incorporated herein by reference.

CROSS-REFERENCE TO RELATED APPLICATION

This application contains subject matter which is related to commonly U.S. patent application Ser. No. 15/341,937, filed Nov. 2, 2016, entitled "Dimmer Switches and Assemblies for Dimmer Switches," by Renjith Mathew, Ronald Jansen, Alfred Lombardi, and Adam Kevelos. The entire subject matter of this application being incorporated herein by reference.

FIELD OF THE DISCLOSURE

The present disclosure relates generally to an electrical load control device, and more particularly, relates to an electrical load control device with a light indicator.

DESCRIPTION OF THE RELATED ART

Conventional electrical load control devices, such as toggle switches, may include an internal light source. The light source is often used as a locator light, or a pilot light. As a locator light, the light source provides a visual indication of where the load control device is located in a room when power is not being supplied to the load (i.e. light fixture). As a pilot light, the light source provides a visual indication that power is being supplied to the load. When the light source is incorporated in a toggle switch, the visible light from the light source either illuminates the whole actuator or illuminates the bottom of the toggle frame somewhere between the actuator and the toggle frame. However, there are disadvantages to the visible light illuminating at these locations. For example, when the whole actuator is illuminated, it is not always aesthetically pleasing, as internal components of the actuator are often visible to a user. When the light source illuminates the bottom of the toggle frame, the actuator blocks most of the light illuminating from the light source when the actuator is in a downward position. In addition, the physical location of the light source within the load control device often requires a complicated light pipe design, causing loss of light intensity when the light illuminating from the light source is directed through the light pipe, and resulting in a weaker light output. There is a need for an electrical load control device with a light source that emits light with minimal observable loss of light intensity, is visible regardless of the actuator orientation, and is aesthetically pleasing.

SUMMARY OF THE DISCLOSURE

An electrical load control device is disclosed. The electrical load control device preferably includes an actuator assembly having a frame and an ON/OFF actuator pivotally coupled to the frame and moveable between a first position and a second position. The first and second positions alternately define ON and OFF states of an electrical load, and the actuator includes first and second surfaces. The actuator assembly also includes a light pipe that is arranged within the actuator. The light pipe includes a first leg that extends towards the first surface of the actuator and a second leg that extends towards the second surface of the actuator. In addition, the electrical load control device preferably includes a light source that is configured to illuminate when the electrical load is in at least one of the ON and OFF states. In use, when the actuator is in the first position, the light source is optically aligned with one of the first and second legs of the light pipe; and, when the actuator is in the second position, the light source is optically aligned with the other of the first and second legs of the light pipe. When the light source is illuminated, the respective first and second leg directs a substantial portion of light emitted from the light source to the respective first and second surface of the actuator.

In a second, alternate embodiment of an electrical load control device, the electrical load control device preferably includes an actuator assembly having a frame and an ON/OFF rocker pivotally coupled to the frame and moveable between a first position and a second position. The first and second positions alternately define ON and OFF states of an electrical load; and, the rocker includes first and second ends and top and bottom surfaces. The actuator assembly also includes first and second light pipes. The first light pipe may extend from the bottom surface of the first end of the rocker, and the second light pipe may extend from the bottom surface of the second end of the rocker. In addition, the electrical load control device preferably includes first and second light sources. The first light source is configured to be aligned with the first light pipe when the rocker is in the first position, and the second light source is configured to be aligned with the second light pipe when the rocker is in the second position. Illumination of at least one of the first and second light sources is dependent on the electrical load being in one of the ON and OFF states. In use, when the first light source illuminates and the rocker is in the first position, the first light pipe directs a substantial portion of the light emitted from the first light source to the bottom surface of the first end of the rocker. When the second light source illuminates and the rocker is in the second position, the second light pipe directs a substantial portion of the light emitted from the second light source to the bottom surface of the second end of the rocker.

In another alternative embodiment of an electrical load control device, the electrical load control device preferably includes an actuator assembly having a frame and an ON/OFF actuator pivotally coupled to the frame and movable between a first position and a second position. The first and second positions alternately define ON and OFF states of an electrical load. The actuator assembly also includes a light pipe that is arranged within the actuator. The light pipe includes a first let and a second leg. In addition, the electrical load control device preferably includes a light source that is configured to illuminate when the electrical load is in at least one of the ON and OFF states. In use, when the actuator is in the first position, the light source is optically aligned with one of the first and second legs of the light pipe; and, when the actuator is in the second position, the light source is optically aligned with the other of the first and second legs of the light pipe.

A switch actuator assembly is also disclosed. The switch actuator assembly preferably includes a frame and an ON/OFF actuator pivotally coupled to the frame and movable between a first position and a second position. The first and second positions alternately define ON and OFF states of an electrical load, and the actuator includes first and second ends, with the first and second ends each having an inner surface and an outer surface. The switch actuator assembly also preferably includes a light pipe having a first let and a second leg. The first leg extends towards the inner surface of the first end of the actuator, and the second leg extends towards the inner surface of the second end of the actuator. In use, when the actuator is in the first position, the light source is optically aligned with one of the first and second legs; and, when the actuator is in the second position, the light source is optically aligned with the other of the first and second legs. When light is emitted from the light source, a substantial portion of the light is directed by one of the first and second legs of the light pipe onto at least a portion of the inner surface of the respective first and second ends of the actuator. The light is then emitted from at least a portion of the respective outer surface of the respective end of the actuator.

In a second, alternate embodiment of a switch actuator assembly, the switch actuator assembly preferably includes a frame and an ON/OFF rocker pivotally coupled to the frame and movable between a first position and a second position. The first and second positions alternately define ON and OFF states of an electrical load, and the rocker includes first and second ends and top and bottom surfaces. The switch actuator assembly also preferably includes first and second light pipes. The first light pipe extends from the bottom surface of the first end of the rocker, and the second light pipe extends from the bottom surface of the second end of the rocker.

BRIEF DESCRIPTION OF THE DRAWING(S)

One or more aspects of the disclosed subject matter are particularly pointed out and distinctly claimed as examples in the claims at the conclusion of the specification. The foregoing and other objects, features, and advantages of the disclosed subject matter may be more readily understood by one skilled in the art with reference being had to the following detailed description of several embodiments thereof, taken in conjunction with the accompanying drawings wherein like elements are designated by identical reference numerals throughout the several views, and in which:

DETAILED DESCRIPTION

The present disclosure describes a system and method for an electrical load control device with a light indicator. Embodiments will be described below while referencing the accompanying figures. The accompanying figures are merely examples and are not intended to limit the scope of the present disclosure.

Figure 2:
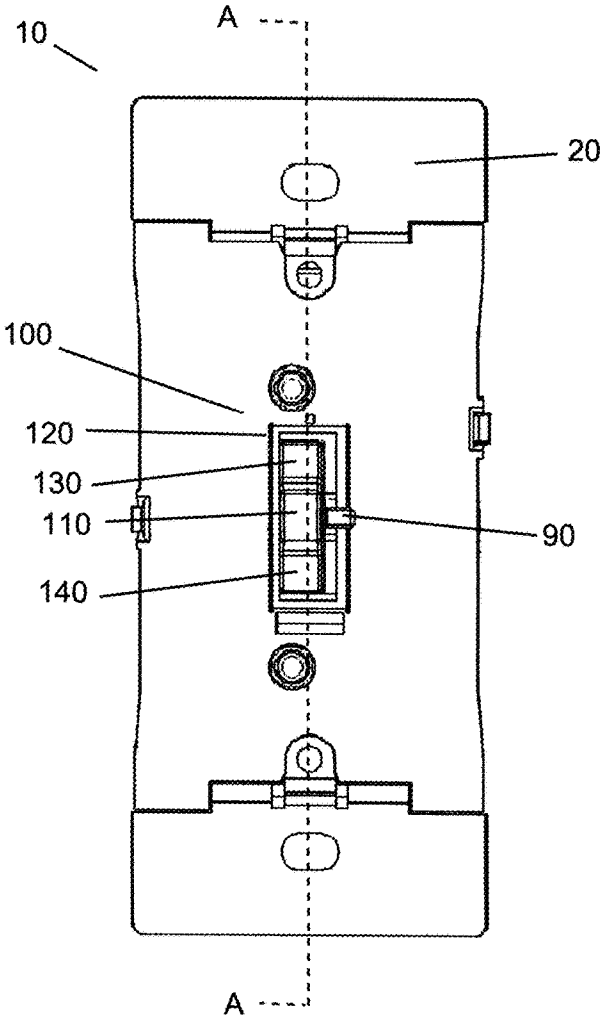
FIG. 2 is a front view of the electrical load control device of FIG. 1.
Figure 1:
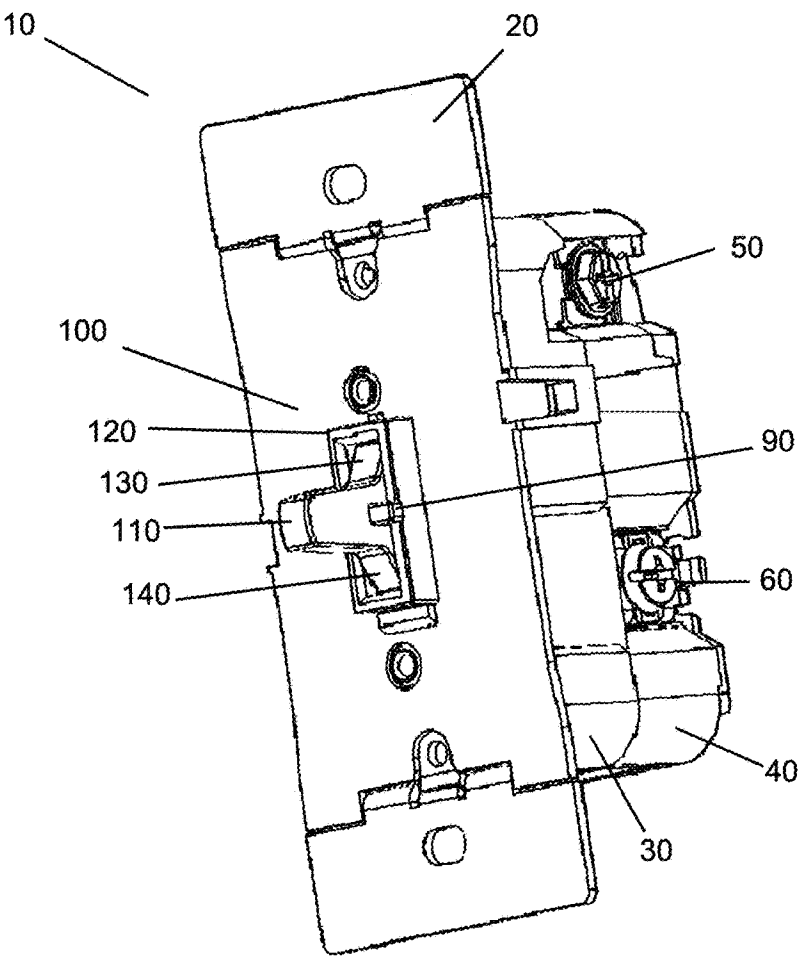
FIG. 1 is a perspective view of an exemplary embodiment of an electrical load control device.
Figure 2A:
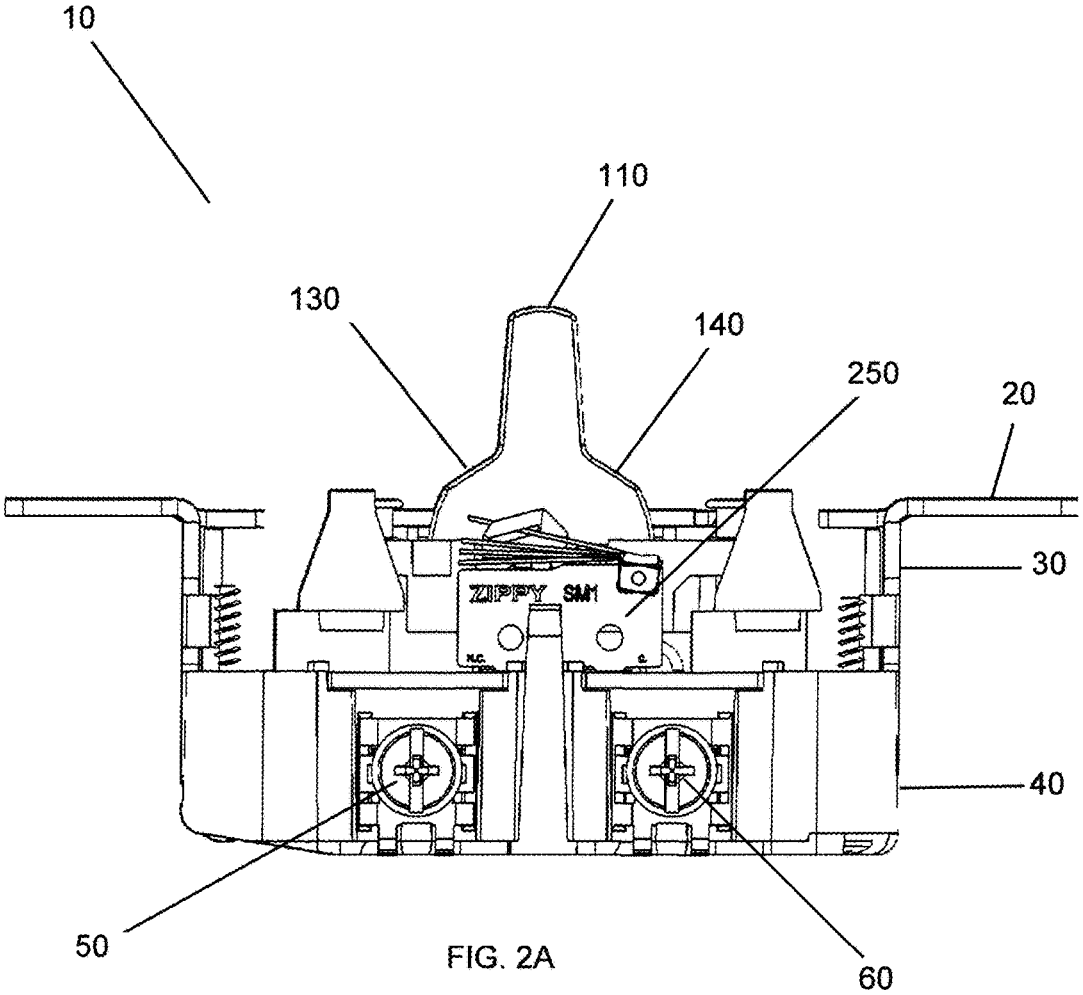
FIG. 2A is a side view of the electrical load control device of FIGS. 1-2 with a front plate removed.
Figure 3:
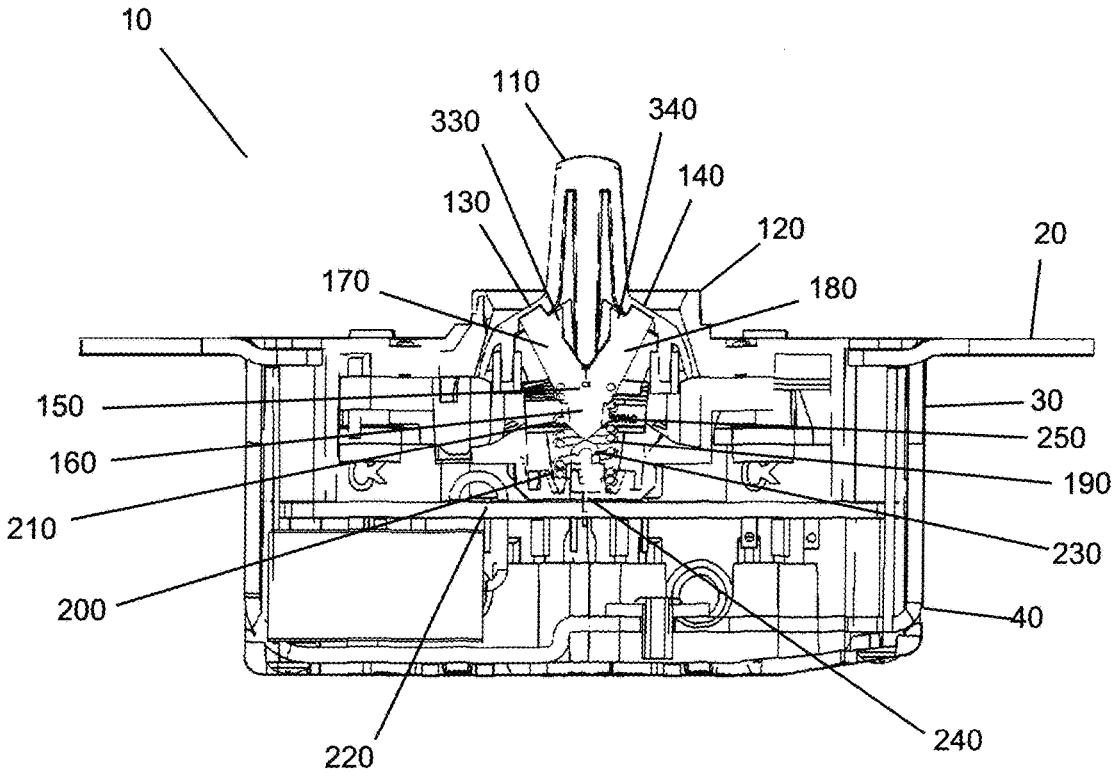
FIG. 3 is a sectional view of the electrical load control device of FIGS. 1-2 taken along section line A-A.

FIGS. 1-3 illustrate an exemplary embodiment of an electrical load control device 10. As shown, the electrical load control device 10 may include mounting portions 20, an upper housing 30, a lower housing 40, first and second terminals 50, 60, and an actuator assembly 100. The mounting portions 20 are configured to mount the electrical load control device 10 to an electrical junction box (not shown). The first and second terminals 50, 60 are configured to secure electrical conductors (not shown) to the electrical load control device 10. As will be described in more detail below, the actuator assembly 100 may include a toggle 110 and a frame 120. The toggle 110 may include a first toggle shoulder 130 and a second toggle shoulder 140.

In addition, as depicted in FIGS. 2-3, the electrical load control device 10 may include a printed circuit board (PCB) 220, a light source 230, and an electrical switching device 250 (i.e. microswitch, tact switch, push-push switch, mechanical switch, relay switch, etc.). The electrical switching device 250 is adapted and configured for turning power "on" and "off" to an electrical load (not shown). The PCB 220 may be supported by the lower housing 40, and holds circuitry for performing functions such as turning power "on" and "off" to the electrical load. The light source 230 is fixed and coupled to the PCB 220 by leads 240. Furthermore, the electrical load control device 10 may include an optional slide actuator and slide switch 90 to adjust the level of power to the electrical load for dimmer and motor load control applications.

In use, the toggle 110 of the actuator assembly 100 is pivotably supported within the frame 120, and is movable through a range of travel, for example, to a first position (see FIG. 4) and a second position (see FIG. 5) to operate the electrical switching device 250, which makes and breaks electrical contact between the terminals 50, 60. In one exemplary embodiment of a single pole switch, the first position of the toggle 110 may correspond to the "off" position of the electrical load control device 10; while the second position of the toggle 110 may correspond to the "on" position of the electrical load control device 10. That is, when the toggle 110 is in the second position, the toggle 110 is pressing down on the electrical switching device 250, thereby actuating the electrical switching device 250 and turning the power "on"; and, when the toggle 110 is in the first position, the toggle 110 is not pressing down on or actuating the electrical switching device 250, and thus the power is "off." However, it will be understood by one of ordinary skill in the art that in other embodiments, such as but not limited to embodiments which include a three-way switch, the "on" and "off" status of the electrical load control device with respect to the toggle position may change.

As shown in the exemplary embodiment of FIGS. 1-7, the electrical load control device 10 includes a toggle 110; however, it will be understood by one of ordinary skill in the art that other types of actuators may be used, such as a rocker. In addition, the electrical load control device may include any suitable number of terminals to secure electrical conductors to the electrical load control device.

Referring to FIG. 3, an exemplary embodiment of the actuator assembly 100 will now be described. As previously mentioned, the actuator assembly 100 may include a toggle 110 and a frame 120; and, the toggle 110 may include a first toggle shoulder 130 and a second toggle shoulder 140. In addition, the actuator assembly 100 may include a light pipe, light guide or translucent member 150 and a resilient member 190 (i.e. spring), in which the light pipe 150 is arranged within the toggle. The light pipe 150 may include a body or protrusion 160, a first leg 170, and a second leg 180. The first leg 170 may extend towards the first toggle shoulder 130, and the second leg 180 may extend towards the second toggle shoulder 140. The resilient member 190 may include a first end 200 and a second end 210. The first end 200 of the resilient member 190 being at least partially optically aligned with the light source 230, and the second end 210 of the resilient member 190 at least partially surrounding the light pipe 150 or the toggle 110.

Figure 4:
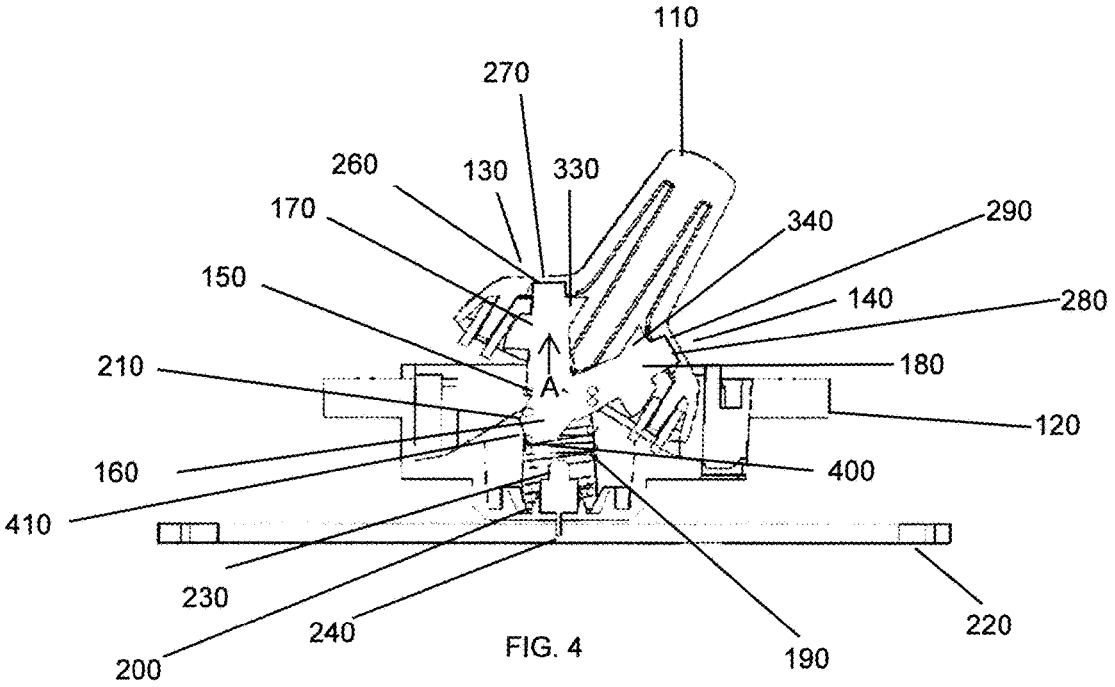
FIG. 4 is a sectional view of a toggle actuator assembly of the electrical load control device of FIGS. 1-2 taken along section line A-A, in which an actuator is in a first position.
Figure 5:
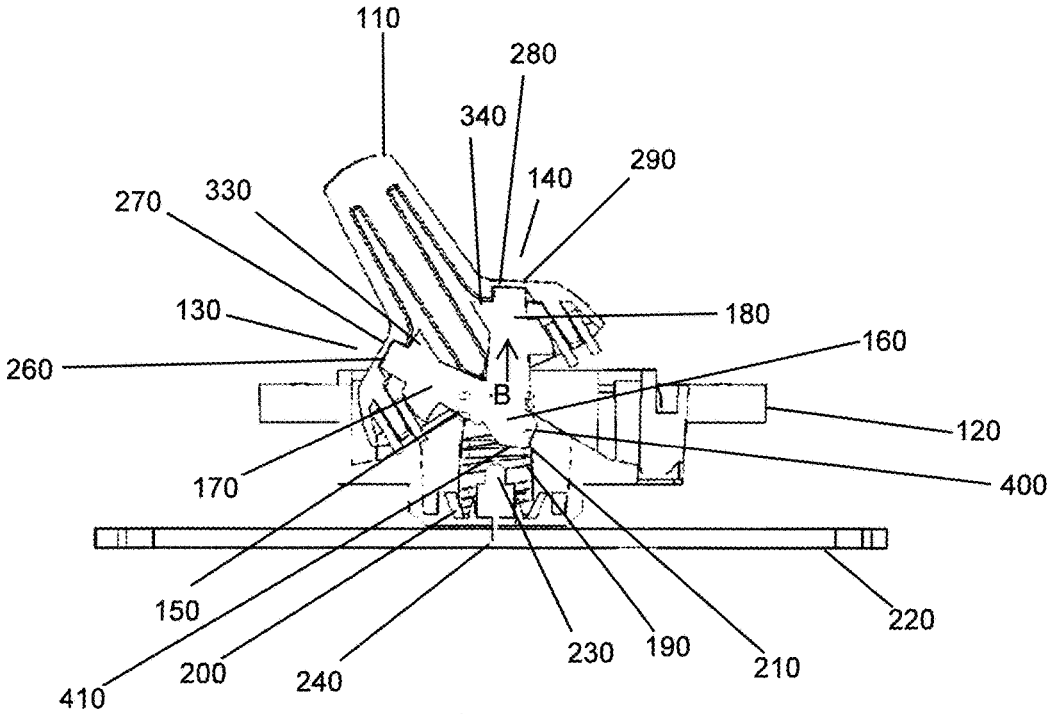
FIG. 5 is a sectional view of the toggle actuator assembly of the electrical load control device of FIGS. 1-2 taken along section line A-A, in which the actuator is in a second position.

In use, the toggle 110 may pivotally rotate through a range of travel, for example, to a first position (see FIG. 4) and a second position (see FIG. 5). As shown in FIG. 4, when the toggle 110 is in the first position, a first entry surface 400 of the first leg 170 is optically aligned with the light source 230. If light is emitted from the light source 230 when the toggle 110 is in the first position, the first leg 170 of the light pipe 150 is configured to direct the light from the light source 230 towards an inner surface 260 of the first toggle shoulder 130. That is, light emitted from the light source 230 travels through the first leg 170 of the light pipe 150 in a general direction as illustrated by arrow A. The light is transmitted through the inner surface 260 of the first toggle shoulder 130, and emitted from at least a portion of an outer surface 270 of the first toggle shoulder 130, in which the light is observable by a user. As shown in FIG. 5, when the toggle 110 is in the second position, a second entry surface 410 of the second leg 180 is optically aligned with the light source 230. If light is emitted from the light source 230 when the toggle 110 is in the second position, the second leg 180 of the light pipe 150 is configured to direct the light from the light source 230 towards an inner surface 280 of the second toggle shoulder 140. That is, light emitted from the light source 230 travels through the second leg 180 of the light pipe 150 in a general direction as illustrated by arrow B. The light is transmitted through the inner surface 280 of the second toggle shoulder 140, and emitted from at least a portion of an outer surface 290 of the second toggle shoulder 140, in which the light is observable by a user.

Thus, if light is emitted from the light source 230, the light from the light source 230 is visible by a user regardless of the toggle orientation (i.e. first position, second position); and, the optical alignment of the light source 230 with the entry surface 400, 410 of the respective first or second leg 170, 180 of the light pipe 150 allows the light from the light source 230 to be emitted to a user visible surface (i.e. first toggle shoulder 130, second toggle shoulder 140). Furthermore, the light pipe 150 allows the light source 230 to be positioned at a distance away from the respective user visible surface with minimal observable loss of intensity of the light source 230 by the user.

When the light source 230 is "off," there are no observable indications that the electrical load control device 10 includes the light source 230, as the light source 230 is not on an external surface of the electrical load control device 10 and the electrical load control device 10 is free of any indents or holes to indicate that there is a light source. That is, the light source is a hidden indicator light, as described further in U.S. Pat. No. 9,329,607, entitled "Electrical Load Controller Having a Frame with an Integrally Formed Backlightable Indicator Region" and filed on Aug. 8, 2014, which is hereby incorporated by reference.

In single pole switch applications, when the toggle is in the first position, the electrical switching device (and the power to the load) is in one of an "on" and "off" status; and, when the toggle is in the second position, the electrical switching device (and the power to the load) is in the other of the "on" and "off" status. In other applications, such as but not limited to three-way switch and four-way switch applications, the "on" and "off" status with respect to the toggle position may change. In embodiments of single pole, three-way, four-way or any other applications now or hereinafter known by one of ordinary skill in the art, the light source 230 may be configured to turn "on" when the power to the load is "off," and the light source 230 may be configured to turn "off" when the power to the load is "on." Thus, in these embodiments, the light source 230 may act as a locator light. However, it will be appreciated that in alternative embodiments, the light source 230 may have other configurations. For example, the light source 230 may be configured to turn "on" when the power to the load is "on," and the light source 230 may be configured to turn "off" when the power to the load is "off." Thus, in these embodiments, the light source 230 may act as a pilot light. Furthermore, in some embodiments, the light source 230 may be configured to dim/bright instead of or in addition to being configured to turn on/off.

Figure 7:
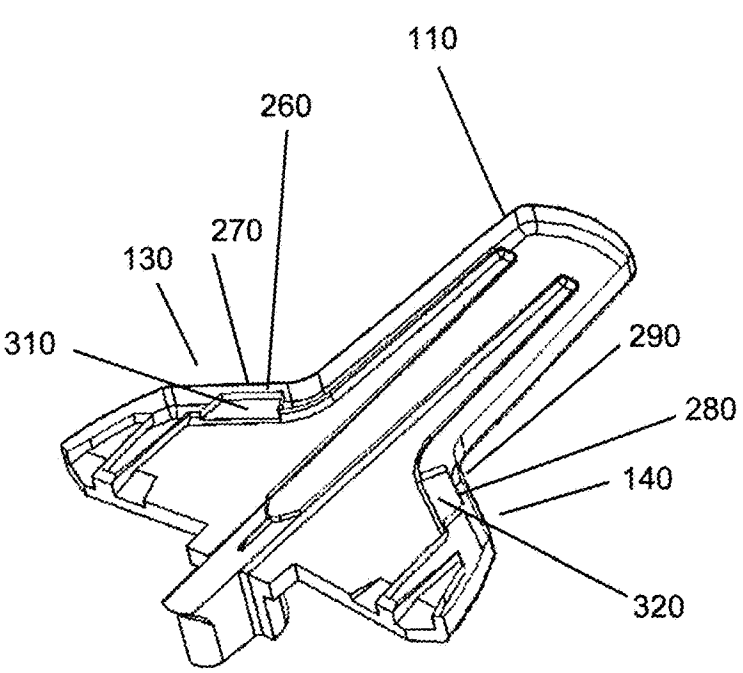
FIG. 7 is a perspective sectional view of the actuator of FIG. 6.
Figure 6:
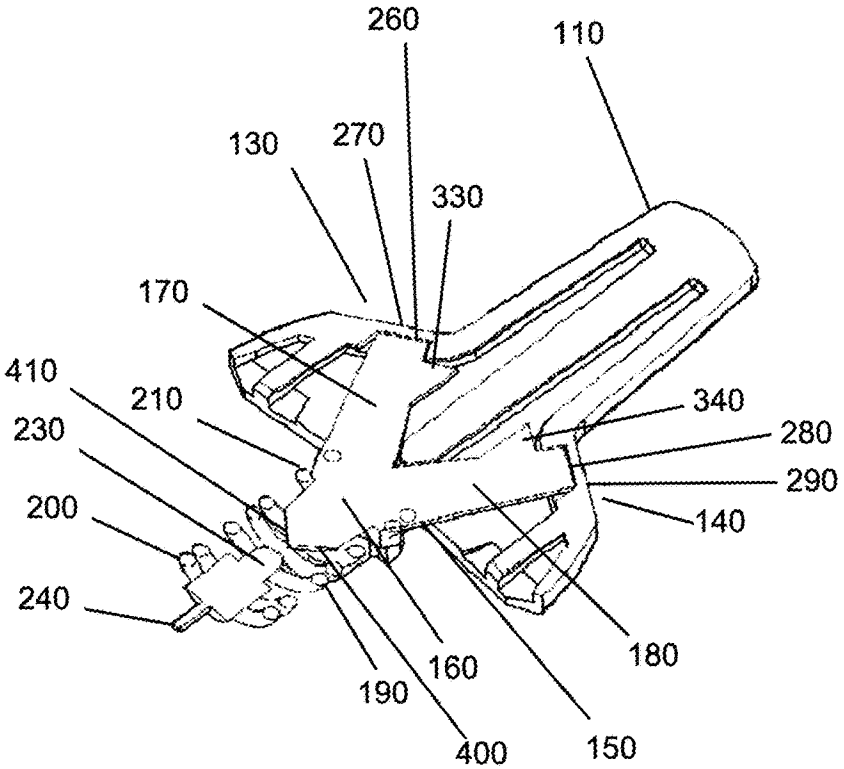
FIG. 6 is a perspective sectional view of the actuator, a light pipe, and a light source taken along section line A-A.

As shown in FIGS. 6-7, the inner surface 260 of the first toggle shoulder 130 may include a first recess 310 to receive a portion of the first leg 170 of the light pipe 150, and the inner surface 280 of the second toggle shoulder 140 may include a second recess 320 to receive a portion of the second leg 180 of the light pipe 150. The first and second recesses 310, 320 may reduce the thickness of the first and second toggle shoulders 130, 140, in which light from the light source 230 may be directed towards, allowing for greater transmittivity of light from the light source 230. In alternative embodiments, the inner surfaces of the first and second toggle shoulders may not include recesses. The toggle 110, including the first and second toggle shoulders 130, 140, may be any type of suitable thickness, material, or color, such that the first and second toggle shoulders are configured to allow light emitted from the light source 230 to be transmitted through the inner surface of the respective toggle shoulder and emitted from at least a portion of the outer surface of the respective toggle shoulder, such that it is observable by a user. In the exemplary embodiment described above and shown in FIGS. 1-7, the outer surfaces 270, 290 of the respective first and second toggle shoulders 130, 140 are flush with the rest of the outer surfaces of the toggle 110; however, in alternative embodiments the outer surfaces of the first and second toggle shoulders may include a recess, a protrusion/raised portion, include an opening there through, etc.

Figure 13:
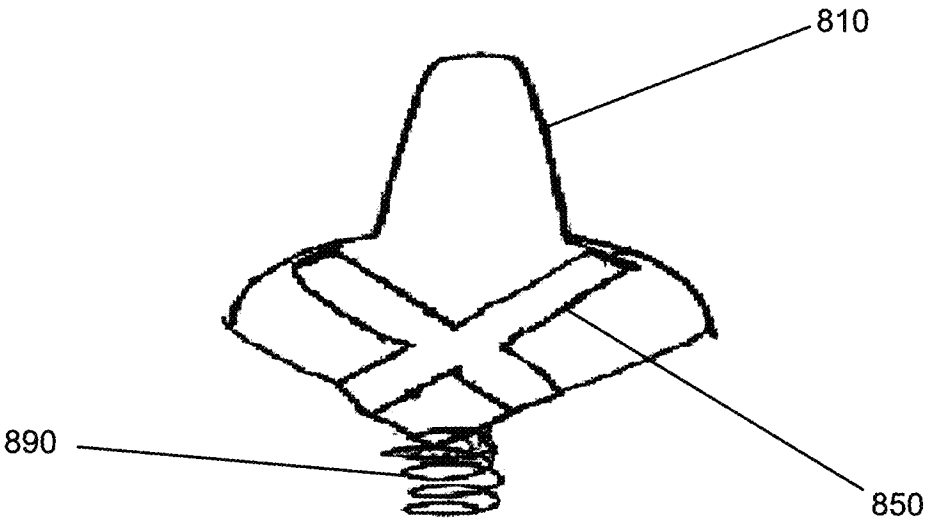
FIG. 13 is a side sectional view of an exemplary embodiment of a toggle, a light pipe, and a resilient member.

The light pipe 150 may further include a first bearing surface 330 and a second bearing surface 340, and the toggle 110 may include first and second receiving surfaces. The first and second bearing surfaces 330, 340 may be sized and shaped to facilitate holding the light pipe 150 in place when the light pipe 150 is arranged within the toggle 110. That is, the first and second receiving surfaces of the toggle may be arranged and configured to receive the respective bearing surfaces. However, in alternative exemplary embodiments, the light pipe may not include first and second bearing surfaces. In the exemplary embodiment described above and shown in FIGS. 1-7, the light pipe is solid and composed of a rigid plastic material; however, in alternative embodiments the light pipe may be hollow, flexible, and/or another suitable optically conductive material, such as but not limited to optical fiber, optical grade plastic, etc. Furthermore, in the exemplary embodiment described above, the light pipe is unitary; however, in alternative embodiments the light pipe may include multiple pieces (i.e. a first light pipe and a second light pipe). In other alternative, exemplary embodiments, the light pipe may be of other configurations, such as but not limited to the light pipe 850 (see FIG. 13) arranged within toggle 810.

As previously mentioned, the light source 230 is coupled to the PCB 220 by leads 240, and is at least partially optically aligned with the first end 200 of the resilient member 190. However, in alternative embodiments, the resilient member may not be at least partially optically aligned with the light source. In the exemplary embodiment shown in FIGS. 1-7, the light source 230 is a light-emitting diode (LED); however, it will be understood by one of ordinary skill in the art that the light source may be any type of light, including but not limited to, a fluorescent lamp, incandescent lamp, neon bulb, etc. that is appropriately sized and configured to cooperate with the light pipe.

The actuator assembly 100 and the optional slide actuator and slide switch 90 for dimmer and motor load control applications may be removable. That is, the actuator assembly 100 and optional slide actuator and slide switch 90 may be configured to be releasably attached to the electrical load control device to allow a user to easily replace an existing assembly with a new assembly, for example, in the case that the existing assembly is damaged. In another example, a releasably attached actuator assembly may be part of an interchangeable color/aesthetic change kit that enables an installer or end user to easily change the color/aesthetic of the visible portions of the device to coordinate with changes in the building decor or occupant preferences. Alternatively, as will be appreciated by one of ordinary skill in the art, the actuator assembly may be permanently coupled to the device. Aesthetic may include different actuator shapes, sizes, textures, etc.

Figure 8:
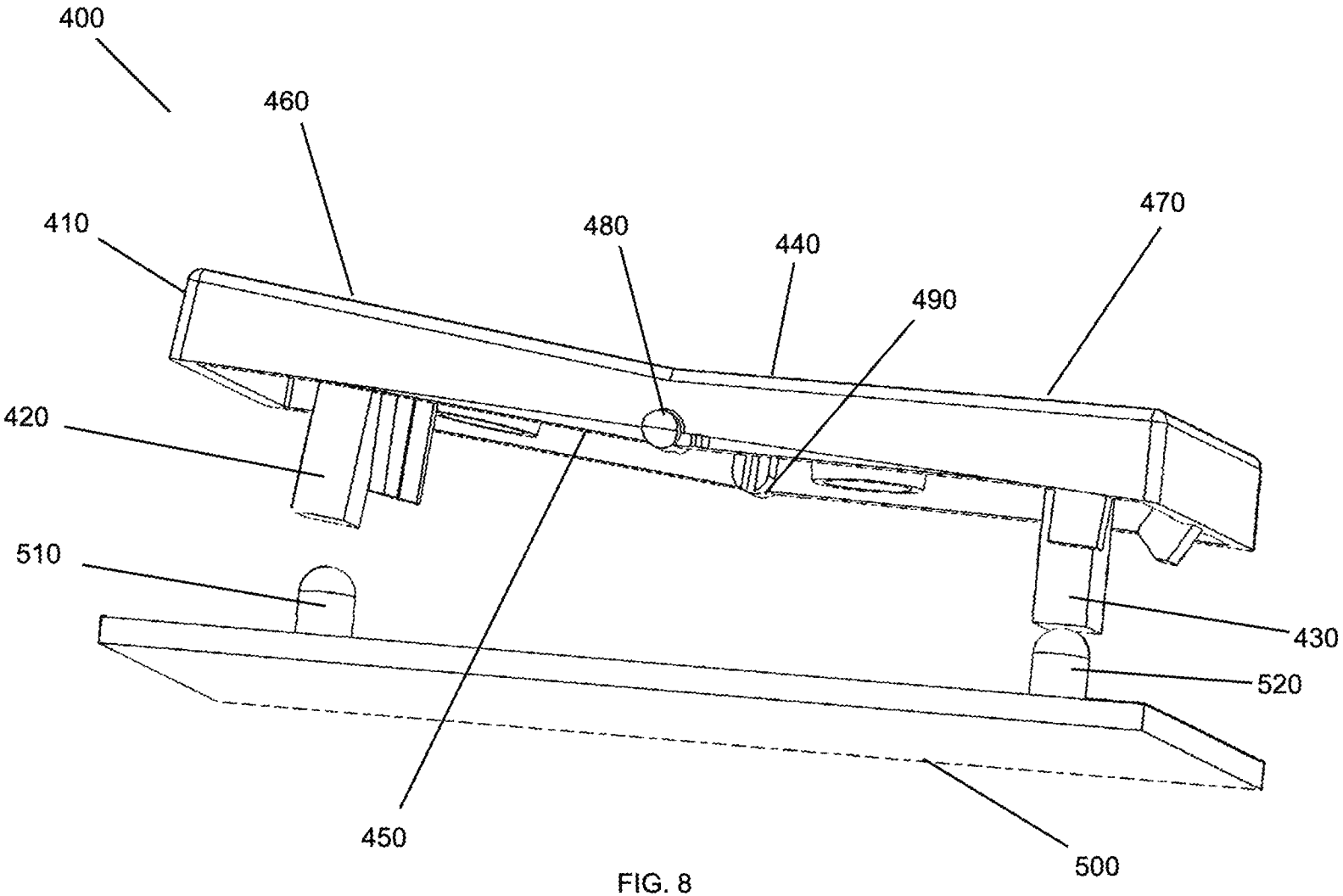
FIG. 8 is a perspective view of an exemplary embodiment of a rocker actuator assembly of an electrical load control device.
Figure 9:
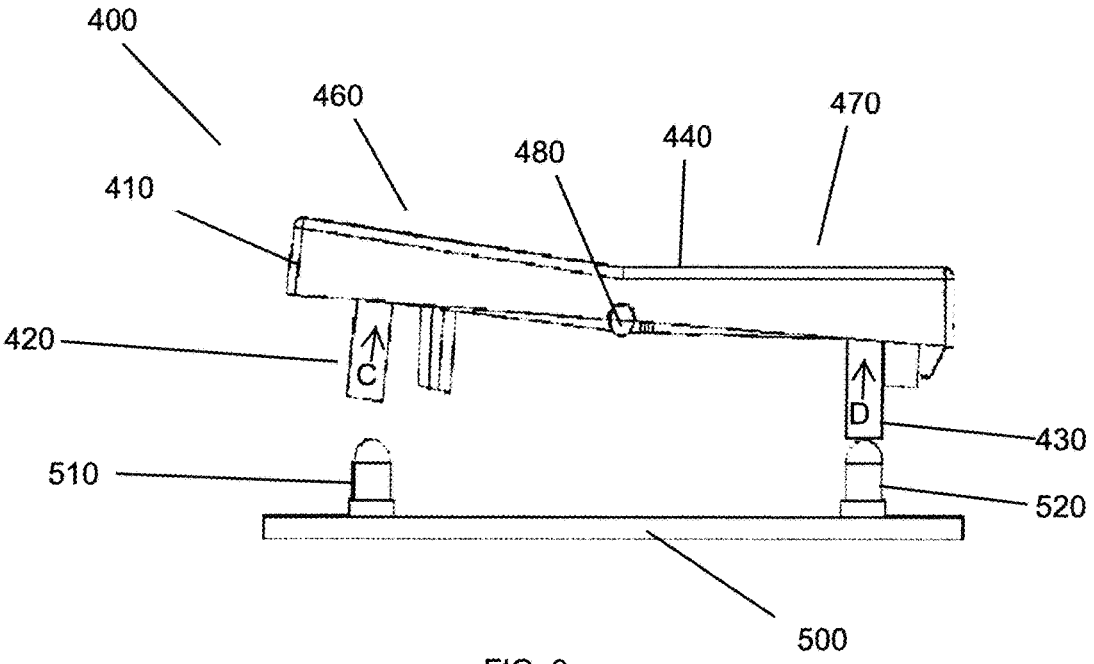
FIG. 9 is a side view of the rocker actuator assembly of FIG. 8.
Figure 10:
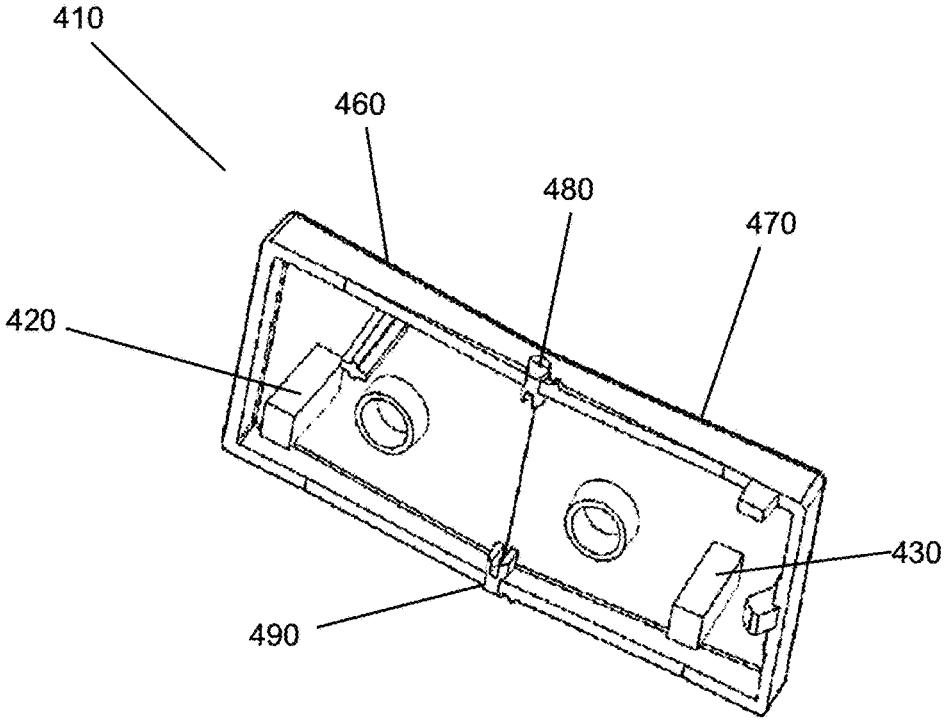
FIG. 10 is a bottom perspective view of an actuator of the rocker actuator assembly of FIGS. 8-9.

FIGS. 8-10 show another alternative exemplary embodiment of an actuator assembly 400 of an electrical load control device (not shown) that is substantially similar to the actuator assembly 100 and corresponding electrical load control device 10 illustrated in FIGS. 1-7 and discussed above, but for the following additional features. The actuator assembly 400 may include a rocker 410, a first light pipe 420, and a second light pipe 430. The rocker 410 may include top and bottom surfaces 440, 450, first and second ends 460, 470, and first and second pins 480, 490. The pins 480, 490 may be configured to couple to a frame (not shown) of the electrical load control device and pivotally rotate within the frame from a first position to a second position. The first light pipe 420 may extend from the bottom surface 450 of the first end 460 of the rocker 410, and the second light pipe 430 may extend from the bottom surface 450 of the second end 470 of the rocker 410. In addition, first and second light sources 510, 520 may be fixed and coupled to a PCB 500 by leads.

In use, the rocker 410 may pivotally rotate through a range of travel, for example, to a first position (not shown) and a second position (see FIGS. 8-9). When the rocker 410 is in the first position, the first end 460 of the rocker 410 is depressed, and the first light pipe 420 is optically aligned with the first light source 510. If light is emitted from the first light source 510 when the rocker 410 is in the first position, the first light pipe 420 is configured to direct the light from the first light source 510 towards the bottom surface 450 of the first end 460 of the rocker 410. That is, light emitted from the first light source 510 travels through the first light pipe 420 in a general direction as illustrated by arrow C (see FIG. 9). The light is transmitted through the bottom surface 450 of the first end 460 of the rocker 410, and emitted from at least a portion of the top surface 440 of the first end 460 of the rocker 410, in which the light is observable by a user. When the rocker 410 is in the second position, the second end 470 of the rocker 410 is depressed, and the second light pipe 430 is optically aligned with the second light source 520. If light is emitted from the second light source 520 when the rocker 410 is in the second position, the second light pipe 430 is configured to direct the light from the second light source 520 towards the bottom surface 450 of the second end 470 of the rocker 410. That is, light emitted from the second light source 520 travels through the second light pipe 430 in a general direction as illustrated by arrow D (see FIG. 9). The light is transmitted through the bottom surface 450 of the second end 470 of the rocker 410, and emitted from at least a portion of the top surface 440 of the second end 470 of the rocker 410, in which the light is observable by a user. Thus, the actuator assembly 400 may be configured such that light may be visible by a user regardless of the rocker orientation; and, the optical alignment of the first and second light source 510, 520 with the respective light pipe 420, 430 allows the light from the light source to be emitted to a user visible surface.

In single pole switch applications, when the rocker 410 is in the first position, the electrical switching device (and the power to the load) is in one of an "on" and "off" status; and, when the rocker 410 is in the second position, the electrical switching device (and the power to the load) is in the other of the "on" and "off" status. In three-way switch applications, the "on" and "off" status with respect to the rocker position may change. In embodiments of single pole, three-way, four-way or any other applications now or hereinafter known by one of ordinary skill in the art, the corresponding light source (i.e. light source 510, 520) may be configured to turn "on" when the power to the load is "off," and the corresponding light source (i.e. light source 510, 520) may be configured to turn "off" when the power to the load is "on." Thus, in these embodiments, the corresponding light source (i.e. light source 510, 520) may act as a locator light. However, it will be appreciated that in alternative embodiments, the light sources (i.e. light source 510, 520) may have other configurations. For example, the corresponding light source (i.e. light source 510, 520) may be configured to turn "on" when the power to the load is "on," and the corresponding light source (i.e. light source 510, 520) may be configured to turn "off" when the power to the load is "off" Thus, in these embodiments, the corresponding light source (i.e. light source 510, 520) may act as a pilot light.

Figure 12:
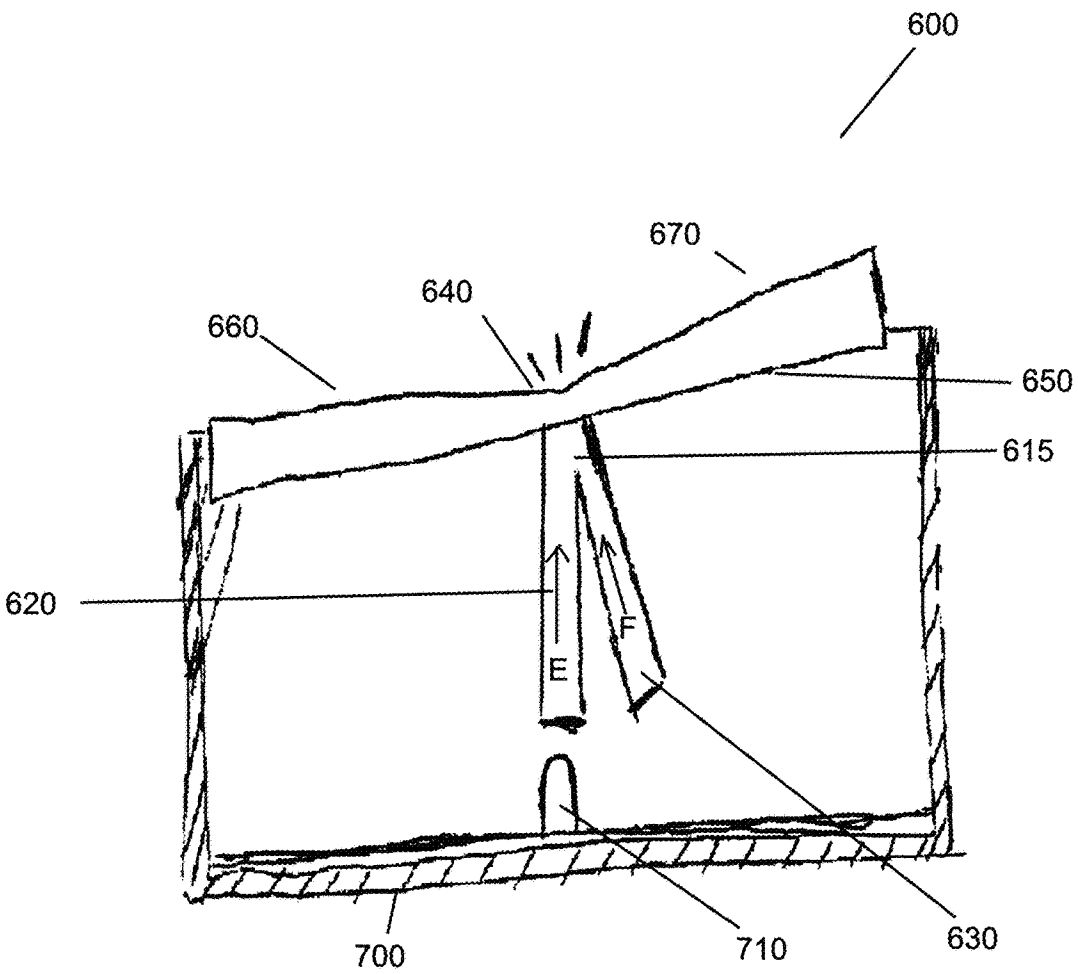
FIG. 12 is a sectional view of the rocker actuator assembly of FIG. 11 taken along section line B-B.
Figure 11:
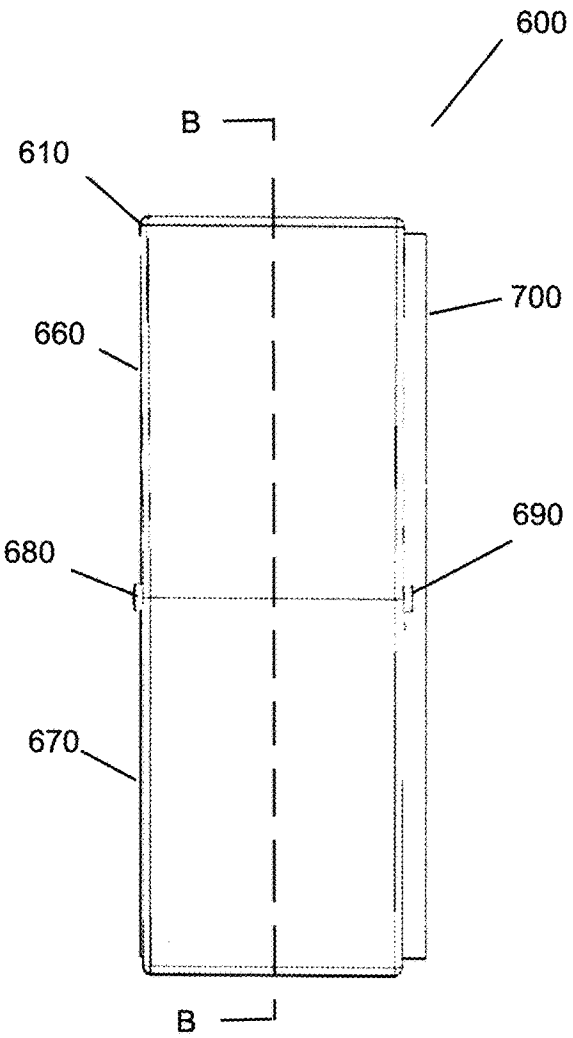
FIG. 11 is a front view of an exemplary embodiment of a rocker actuator assembly of an electrical load control device.

FIGS. 11-12 show another alternative exemplary embodiment of an actuator assembly 600 of an electrical load control device (not shown) that is substantially similar to the actuator assembly 100 and corresponding electrical load control device 10 illustrated in FIGS. 1-7 and discussed above, but for the following additional features. The actuator assembly 600 may include a rocker 610 and a light pipe 615. The rocker 610 may include top and bottom surfaces 640, 650, first and second ends 660, 670, and first and second pins 680, 690. The pins 680, 690 may be configured to couple to a frame (not shown) of the electrical load control device and pivotally rotate within the frame from a first position to a second position. The light pipe 615 may be generally "V-shaped" and include a first leg 620 and a second leg 630. The light pipe may extend from the bottom surface 650 of the rocker 610. In addition, a light source 710 may be positioned generally in the middle of a PCB 700 and be fixed and coupled to the PCB 700 by leads.

In use, the rocker 610 may pivotally rotate through a range of travel, for example, to a first position (see FIG. 12) and a second position (not shown). When the rocker 610 is in the first position, the first end 660 of the rocker 610 is depressed, and the first leg 620 of the light pipe 615 is optically aligned with the light source 710. If light is emitted from the light source 710 when the rocker 610 is in the first position, the first leg 620 of the light pipe 615 is configured to direct the light from the light source 710 towards the bottom surface 650 of the rocker 610. That is, light emitted from the light source 710 travels through the first leg 620 of the light pipe 615 in a general direction as illustrated by arrow E (see FIG. 12). The light is transmitted through the bottom surface 650 of the rocker 610, and emitted from at least a portion of the top surface 640 of the rocker 610, in which the light is observable by a user. When the rocker 610 is in the second position, the second end 670 of the rocker 610 is depressed, and the light source 710 is optically aligned with the light source 710. If light is emitted from the light source 710 when the rocker 610 is in the second position, the second leg 630 of the light pipe 615 is configured to direct the light from the light source 710 towards the bottom surface 650 of the rocker 610. That is, light emitted from the light source 710 travels through the second leg 630 of the light pipe 615 in a general direction as illustrated by arrow F (see FIG. 12). The light is transmitted through the bottom surface 650 of the rocker 610, and emitted from at least a portion of the top surface 640 of the rocker 610, in which the light is observable by a user. Thus, the actuator assembly 600 may be configured such that light may be visible by a user regardless of the rocker orientation; and, the optical alignment of the light source 710 with the respective leg 620, 630 of the light pipe 615 allows the light from the light source 710 to be emitted to a user visible surface.

In single pole switch applications, when the rocker 610 is in the first position, the electrical switching device (and the power to the load) is in one of an "on" and "off" status; and, when the rocker 610 is in the second position, the electrical switching device (and the power to the load) is in the other of the "on" and "off" status. In three-way switch applications, the "on" and "off" status with respect to the rocker position may change. In embodiments of single pole, three-way, four-way or any other applications now or hereinafter known by one of ordinary skill in the art, the light source 710 may be configured to turn "on" when the power to the load is "off," and the light source 710 may be configured to turn "off" when the power to the load is "on." Thus, in these embodiments, the light source 710 may act as a locator light. However, it will be appreciated that in alternative embodiments, the light source 710 may have other configurations. For example, the light source 710 may be configured to turn "on" when the power to the load is "on," and the light source 710 may be configured to turn "off" when the power to the load is "off" Thus, in these embodiments, the light source 710 may act as a pilot light.

In a further exemplary embodiment, an actuator assembly including a toggle may further include first and second light pipes, in which the first light pipe may be configured to be optically aligned with a first light source and the second light pipe may be configured to be optically aligned with a second light source.

While certain embodiments of the disclosure have been described herein, it is not intended that the disclosure be limited thereto, as it is intended that the disclosure be as broad in scope as the art will allow and that the specification be read likewise. Therefore, the above description should not be construed as limiting, but merely as exemplifications of particular embodiments. Those skilled in the art will envision additional modifications, features, and advantages within the scope and spirit of the claims appended hereto.

What is claimed is:

1. An electrical load control device comprising:

a. an actuator assembly comprising:

i. a frame;

ii. an actuator pivotally coupled to the frame and moveable between a first position and a second position, the first and second positions alternately corresponding to ON and OFF states of an electrical load, and the actuator including first and second surfaces;

iii. a light pipe arranged at least partially within the actuator, the light pipe including:

a body having a first light entry surface and a second light entry surface, the first and second light entry surfaces arranged at an angle with respect to one another, the angle being less than 180 degrees;

a first leg having a proximal end and a distal end, the proximal end originating from the first light entry surface and extending towards the first surface of the actuator;

a second leg having a proximal end and a distal end, the proximal end originating from the second light entry surface and extending towards the second surface of the actuator; and b. a single light source configured to illuminate when the electrical load is in at least one of the ON and the OFF state, wherein when the actuator is in the first position, the single light source is optically aligned with one of the first and second entry surfaces, and wherein when the actuator is in the second position, the single light source is optically aligned with the other of the first and second entry surfaces;

wherein when the single light source is illuminated, the respective leg of the first and second legs of the light pipe directs a substantial portion of the light emitted from the single light source to the respective first and second surfaces of the actuator.

2. The electrical load control device of claim 1, wherein the actuator is a toggle switch, and the first and second surfaces are first and second toggle shoulders, respectively.

3. The electrical load control device of claim 2, wherein the first and second toggle shoulders each include a recess.

4. The electrical load control device of claim 1, wherein the actuator is a rocker, and the first and second surfaces are first and second ends of the rocker, respectively.

5. The electrical load control device of claim 1, wherein the actuator assembly further comprises a resilient member, wherein the resilient member is at least partially aligned with the single light source.

6. The electrical load control device of claim 1, wherein the electrical load control device is one of a single pole switch device, a three-way switch device, and a four-way switch device.

7. The electrical load control device of claim 1, wherein the first and second surfaces each include an inner surface and an outer surface, and wherein the respective leg of the light pipe is configured to direct the light from the single light source towards the respective inner surface, and wherein the light is transmitted through the respective inner surface and emitted from at least a portion of the respective outer surface.

8. The electrical load control device of claim 1, wherein the light pipe further includes first and second bearing surfaces, and the actuator includes first and second receiving surfaces, the first and second receiving surfaces being arranged and configured to receive the respective bearing surfaces.

9. The electrical load control device of claim 1, wherein the actuator assembly is releasably coupled to the electrical load control device.

10. The electrical load control device of claim 1 further comprising a printed circuit board mounted therein, wherein the single light source is electrically coupled to the printed circuit board.

11. The electrical load control device of claim 1 further comprising an electrical switch configured to selectively switch the electrical load between the ON state and the OFF state, and wherein the electrical switch is one of a micro-switch, a tact switch, a push-push switch, a mechanical switch, and a relay switch.

12. A switch actuator assembly comprising:

a. a frame;

b. an actuator pivotally coupled to the frame and moveable between a first position and a second position, the first and second positions alternately corresponding to ON and OFF states of an electrical load, the actuator including first and second ends, the first and second ends each having an inner surface and an outer surface;

c. a single light source;

d. a light pipe including:

a body having a first light entry surface and a second light entry surface, the first and second light entry surfaces arranged at an angle with respect to one another, the angle being less than 180 degrees;

a first leg having a proximal end and a distal end, the proximal end originating from the first light entry surface and extending towards the first surface of the actuator;

a second leg having a proximal end and a distal end, the proximal end originating from the second light entry surface and extending towards the second surface of the actuator; and wherein when light is emitted from the single light source, a substantial portion of the light is directed by one of the first and second legs of the light pipe onto at least a portion of the inner surface of the respective first and second ends of the actuator and emits from at least a portion of the respective outer surface of the respective end of the actuator.

13. The switch actuator assembly of claim 12, wherein the actuator is a toggle switch, and the first and second ends include first and second toggle shoulders, respectively.

14. The switch actuator assembly of claim 12, wherein the actuator is a rocker.

15. The switch actuator assembly of claim 12 further comprising a resilient member, wherein the resilient member is at least partially aligned with the light source and adjacent to the light pipe.

16. The switch actuator assembly of claim 12, wherein the switch is one of a single pole switch device, a three-way switch device, and a four-way switch device.

17. An electrical load control device comprising:

a. an actuator assembly comprising:

i. a frame;

ii. an actuator pivotally coupled to the frame and moveable between a first position and a second position, the first and second positions alternately corresponding to ON and OFF states of an electrical load;

iii. a light pipe arranged at least partially within the actuator, the light pipe including:

a body having a first light entry surface and a second light entry surface, the first and second light entry surfaces arranged at an angle with respect to one another, the angle being less than 180 degrees;

a first leg having a proximal end and a distal end, the proximal end originating from the first light entry surface and extending towards the first surface of the actuator;

a second leg having a proximal end and a distal end, the proximal end originating from the second light entry surface and extending towards the second surface of the actuator; and b. a single light source configured to illuminate when the electrical load is in at least one of the ON and the OFF state, wherein when the actuator is in the first position, the single light source is optically aligned with one of the first and second light entry surfaces of the light pipe, and wherein when the actuator is in the second position, the single light source is optically aligned with the other of the first and second light entry surfaces of the light pipe.

18. The electrical load control device of claim 17, wherein the actuator is a toggle switch, and the first and second surfaces are first and second toggle shoulders, respectively.

19. The electrical load control device of claim 17, wherein the actuator is a rocker.

20. The electrical load control device of claim 17 further comprising a resilient member, wherein the resilient member is at least partially aligned with the light source and adjacent to the light pipe.

* * * * *